United States Patent [19]

Aono et al.

[11] Patent Number: 4,665,005

[45] Date of Patent: May 12, 1987

[54] STRIPPING PROCESS FOR FORMING COLOR IMAGE USING FLUORINE SURFACTANT

[75] Inventors: Toshiaki Aono; Kozo Sato; Yasuo Mukunoki; Koichi Nakamura, all of Kanagawa, Japan

[73] Assignee: Fuji Photo Film Co., Ltd., Kanagawa, Japan

[21] Appl. No.: 832,603

[22] Filed: Feb. 24, 1986

Related U.S. Application Data

[63] Continuation-in-part of Ser. No. 753,467, Jul. 10, 1985, abandoned.

[30] Foreign Application Priority Data

Jul. 10, 1984 [JP] Japan ..... 59-141560

[51] Int. Cl.[4] ..... G03C 5/54; G03C 1/90

[52] U.S. Cl. ..... 430/203; 430/215; 430/256; 430/259

[58] Field of Search ..... 430/203, 259, 256, 215

[56] References Cited

U.S. PATENT DOCUMENTS 3,806,346 4/1974 Bloom et al. ..... 430/215
4,459,346 7/1984 Bishop et al. ..... 430/259
4,500,626 2/1985 Naito et al. ..... 430/203
4,529,683 7/1985 Bishop ..... 430/259
4,550,071 10/1985 Aono et al. ..... 430/203

*Primary Examiner*—Richard L. Schilling
*Attorney, Agent, or Firm*—Sughrue, Mion, Zinn, Macpeak & Seas

[57] ABSTRACT

In heat developable photographic system of dry procedure, color images are formed by imagewise exposing and then heating a light-sensitive material comprising a support having provided thereon a light-sensitive layer containing silver halide, a binder, and a compound capable of producing or releasing, upon reduction of light-sensitive silver halide to silver at elevated temperatures, a mobile dye, as a direct or inverse function of the reduction reaction, allowing the produced or released mobile dye to migrate into a dye-fixing material having incorporated therein a hydrophilic thermal solvent and fixing the dye thereto, then separating the light-sensitive material from the dye-fixing material, with a fluorine-containing surfactant being incorporated in at least one of the uppermost layers on the contacting sides of the light-sensitive material and of the dye-fixing material. Adhesion and poor S/N ratio problems accompanied by the use of hydrophilic thermal solvents are improved by incorporating fluorine-containing surfactants into the aforesaid layers.

16 Claims, No Drawings

STRIPPING PROCESS FOR FORMING COLOR IMAGE USING FLUORINE SURFACTANT

CROSS REFERENCE TO RELATED APPLICATION

This is a continuation-in-part of Ser. No. 753,467 filed July 10, 1985, now abandoned.

FIELD OF THE INVENTION

This invention relates to a novel process for forming a dye image by heating in the substantial absence of water. More particularly, it relates to a novel process for forming a dye image using a light-sensitive material which contains a dye-providing substance capable of reacting with light-sensitive silver halide under heating, in the substantial absence of water, to release a hydrophilic dye. Still more particularly, it pertains to a novel process for obtaining a dye image by allowing the dye released upon heating to migrate or diffuse into a dye-fixing layer.

DEVELOPMENT OF THE INVENTION

Heretofore, photographic process using silver halide has most widely been practiced, since such processes provide excellent sensitivity, gradation, and like photographic properties as compared, for example, with electrophotographic process and diazo-type photographic process. In recent years, techniques have been developed which provide images easily and in short time by employing, as a photographic process for forming images on light-sensitive materials using silver halide, a dry processing involving heating instead of conventional wet processing development in a developing solution.

Heat developable light-sensitive materials are known in the art, and heat developable materials and the process thereof are described in, for example, *Shashin Kagaku No Kiso,* pp. 553 to 55 (published by Corona Co., Ltd., 1979); *Eizo Joho,* April 1978, p. 40; *Nebletts Handbook of Photography and Reprography,* 7th Ed. (Van Nostrand Reinhold Company), pp. 32–33 (1977); U.S. Pat. Nos. 3,152,904, 3,301,678, 3,392,020 and 3,457,075; British Pat. Nos. 1,131,108 and 1,167,777; and *Research Disclosure,* June, 1978, pp. 9–15 (RD-17029).

Many processes have been proposed for obtaining color images. As to a process for forming color images by binding an oxidation product of a developing agent with a coupler, U.S. Pat. No. 3,531,286 proposes p-phenylenediamine type reducing agents and phenolic or active methylene couplers, U.S. Pat. No. 3,761,270 proposes p-aminophenol type reducing agents, Belg. Patent No. 802,519 and *Research Disclosure,* September 1975, pp. 31 and 32 propose sulfonamidophenol type reducing agents, and U.S. Pat. No. 4,021,240 proposes a combination of sulfonamidophenol type reducing agent and 4-equivalent coupler.

However, these processes have the defect that, since an image of reduced silver and a color iamge are simultaneously formed in exposed portions after heat development, the color image becomes turbid. As a means for overcoming this defect, the silver image is removed by a liquid treatment, or the dye alone is transferred to a sheet having another layer, for example, an image-receiving layer. However, it is not so easy to discriminate an unreacted material from a dye and transfer only the dye.

*Research Disclosure,* May, 1978, pp. 54 to 58 described a technique for introducing a nitrogen-containing hetero ring group into a dye, forming a silver salt, and releasing the dye by heat development. This technique fails to provide a distinct image due to difficulty in depressing release of dye in light-nonstruch portions, and thus is not generally employed.

Also, as to a process for forming positive color images according to a light-sensitive silver-dye bleach process, useful dyes and bleaching processes are described, for example, in *Research Disclosure,* April 1976, pp. 30–32 (RD-14433); ibid., December, 1976, pp. 14–15 (RD-15227), and U.S. Pat. No. 4,235,957.

In these processes, however, an additional step and material are necessary for heating the materials with an activator sheet in order to accelerate bleaching of dye superposed on them, and the resulting dye image suffers gradual reductive bleaching during storage with the copresent free silver or the like.

U.S. Pat. Nos. 3,985,565, 4,022,617, etc. describe a process for forming color images by uitilizing leuco dyes. However, with this process, stable incorporation of leuco dye in a photographic material is difficult, and the material is gradually colored during storage.

Further, the above-described processes generally require a comparatively long developing time, and provide images having serious fog and low image density.

As image-forming processes removing the above-described defects, a number of processes have been propsoed which comprise imagewise releasing mobile dyes by oxidation-reduction reaction with light-sensitive silver halide, and llowing the resulting mobile dyes to migrate to an image-fixing layer (U.S. Pat. Nos. 4,500,626, 4,483,914 and 4,455,363, and Japanese Patent Application (OPI) No. 149046/83 (The term "OPI" as used herein refers to a "published unexamined Japanese patent application").

One specific example of these processes comprises bringing a light-sensitive material into contact with a dye-fixing material having a dye-fixing layer to allow an imagewise produced mobile dye to migrate into the fixing layer, and fixing the dye thereto. In this process, the light-sensitive material and the dye-fixing layer must be peeled apart from each other after migration of the dye. Therefore, the surface of the dye-fixing material is required to possess the properties that it closely adheres to the light-sensitive material, permitting sufficient migration of the dye therethrough, and that it permits smooth delamination after heating without forming of surface roughness.

In order to allow the mobile dye to effectively migrate or diffuse into the fixing layer, the use of hydrophilic thermal solvents has been proposed in U.S. Pat. Nos. 3,347,675, 3,667,959, 4,124,387, etc., defining the hydrophilic thermal solvent to be a non-hydrolyzable organic material which is solid at room temperature (about 25° C.) but acts as a solvent within a photographic element upon heating at a dye transferring temperature (about 60° C.). Typical examples of such hydrophilic thermal solvents are polyethylene glycol, beeswax, urea, 1,10-decanediol, methyl anisate, etc. The incorporation of the hydrophilic thermal solvents into the photographic element is very advantageous in that a dye diffusion transfer step can be omitted and excellent dye transfer can be facilitated, resulting in high maximum density. According to the present inventors' investigations, however, it has been found that a serious problem of adhesion between the emulsion layer and the dye-fixing layer newly arise upon peeling by incorporating the hydrophilic thermal solvents into the photographic element. It has also been found that the adhesion problem is very serious in the co-presence of the hydrophilic thermal solvents in case that a light-sensitive layer and a dye-fixing are formed on the same support (the system of this type is sometime referred to as a monosheet type light-sensitive element only for purpose of simplicity) as later shown in the examples. In addition to the adhesion problem, glossiness is poor at the surface of the dye-fixing layer having the transferred dye image thereon so that a reflection density decreases. The foregoing patents and publications fail to note these problems newly found by the present inventors.

As to peeling-apart properties of the dye-fixing material, many proposals have been made with respect to color diffusion transfer process materials for a wet process. It is known to use, for example, a hydrophilic polymer on the surface thereof. In the aforesaid heat developable process, however, delamination is difficult in the case of using ordinarily employed gelatin or polyvinylpyrrolidone, since heating to 60° C. or above is effected for migration of the dye. If delamination is forcibly effected, the surface of the dye-fixing material is roughend to loose its glossiness.

Further, untreated or raw heat developable light-sensitive materials and dye-fixing materials are stored in a state of being superposed over one another, the adhesion problems are more remarkable in the presence of the hydrophilic thermal solvents. Furthermore, the hydrophilic thermal solvents excessively accelerates development upon heating, which causes fog leading to a poor S/N ratio.

U.S. Pat. No. 4,500,624 discloses microencapsulation of a diffusion accelerator in order to prevent degradation of the coating property and film quality of the photographic material. However, there is no teaching or suggestion of the adhesion problem.

U.S. Pat. No. 4,459,346 issued to Bishop et al teaches the use of fluorine-containing stripping agent. However, the process involved therein is a wet diffusion transfer process and as a matter of course, Bishop et al fails to acknowledge the problems encountered only in the heat developable image forming process particularly in a dry system in which transfer is effected by the use of hydrophilic thermal solvents.

SUMMARY OF THE INVENTION

An object of the present invention is to provide a process for forming color image by heating a light-sensitive element comprising a support having provided thereon a material having a light-sensitive layer such as a light-sensitive material (light-sensitive material) and a material having a dye-fixing layer such as a dye-fixing material (dye-fixing material) in contact with each other, and peeling the two materials apart from each other, in which peeling-apart properties are so improved that the surface of the portion having the dye-fixing layer is not roughned after the delamination.

Another object of the present invention is to provide a process which enables easily obtaining color images with good image quality and good image surface by heating.

A further object of the present invention is to provide heat developable light-sensitive materials and/or dye-fixing materials which do not adhere to each other when superposed one over the other.

These and other objects of the present invention will become apparent from the following description thereof.

The above-described and other objects of the present invention are attained by a color image-forming process which comprises imagewise exposing and then heating a light-sensitive material comprising a support having provided thereon a light-sensitive layer containing silver halide, a binder, and a compound capable of producing or releasing, upon reduction of light-sensitive silver halide to silver at elevated temperatures, a mobile dye as a direct or inverse function of the reduction reaction, allowing the produced or released mobile dye to migrate into a dye-fixing material and fixing the dye thereto, then separating the light-sensitive material from the dye-fixing material, with a fluorine-containing surfactant being incorporated in at least one of the uppermost layer on the contacting sides of the light-sensitive material and of the dye-fixing material.

DETAILED DESCRIPTION OF THE INVENTION

In the present invention, a mobile dye is imagewise produced by imagewise exposing and then heating (uniformly) the above-described light-sensitive material having a light-sensitive layer containing silver halide and a compound capable of producing or releasing the mobile dye; the thus produced or released dye is allowed to migrate into a dye-fixing layer and is fixed thereto; then the dye-fixing material is separated from the light-sensitive material to thereby form a color image in the image-fixing layer. In this situation, the presence of a fluorine-containing surfactant to be described hereinafter at the separation surface of the light-sensitive material and/or the dye-fixing material enables peeling apart the dye-fixing material from the light-sensitive material with extreme ease.

In a preferable embodiment of the present invention, an imagewise exposed light-sensitive material having light-sensitive layer containing silver halide, binder, and the compound capable of producing or releasing a mobile dye is brought into contact with the dye-fixing material having the dye-fixing layer after being heated, or is heated upon or after being brought into contact to allow the mobile dye to migrate into a dye-fixing layer and to fix the dye thereto, followed by peeling apart (separating) the dye-fixing material from the light-sensitive material.

In the present invention, the uppermost layer may be a light-sensitive layer or a light-insensitive layer (for example, a protective layer).

The fluorine-containing surfactants to be used in the present invention may be low-molecular weight or high-molecular weight fluorine-containing compounds. Examples of low-molecular weight compound include those which are described in U.S. Pat. Nos. 3,775,126, 3,589,906, 3,798,265, 3,779,768, 4,407,937, West German Patent 1,293,189, British Patent No. 1,259,398, Japanese Patent Application (OPI) Nos. 87826/73, 10722/74, 46733/74, 16525/75, 113221/75, 161236/75, 99525/75, 7917/76, 32322/76, 151125/76, 151126/76, 151127/76, 129229/76, 127974/77, 84712/78, 146622/78, 14224/79, 48520/79, 7762/80, etc. Examples of the high-molecular weight compounds include those which are described in U.S. Pat. Nos. 4,175,969, 4,087,394, 4,016,125, 3,676,123, 3,679,411, 4,304,852, Japanese Patent Application (OPI) Nos. 129520/77, 158222/79, 57842/80, 11342/82, 19735/82, 179837/82, *Kagaku Sosetsu,* No.

27, "Atarashii Fusso Kagaku" (published by Japanese Chemical Society, 1980), *Kinousei Gan-fusso Kobunshi* (compiled by Nikkan Kogyo Shinbunsha, 1982), etc.

These fluorine-containing compounds may be prepared by processes described in the above-described literature, and, more generally, they can be synthesized by fluorination of corresponding hydrocarbons. Detailed descriptions on fluorination of hydrocarbons are set forth in *Shin-Jikken Kagaku Koza,* Vol. 14(I) (Maruzen, 1977), pp.308–331.

In the present invention, the fluorine-containing surfactant is preferably present in an amount of from 0.01 $g/m^2$ to 3 $g/m^2$, and more preferably from 0.05 $g/m^2$ to 1 $g/m^2$, in a light-sensitive material and/or a dye-fixing material.

Preferable examples of the fluorine-containing compounds to be used in the present invention are illustrated below.

$$CF_3-(CF_2)_6-CO_2NH_4 \quad (1)$$

$$CF_3-(CF_2)_3-(CH_2)_{10}-CO_2Na \quad (2)$$

$$CF_3-(CF_2)_6-\underset{\underset{C_2H_5}{|}}{CON}-(CH_2)_2-SO_3K \quad (3)$$

(4)

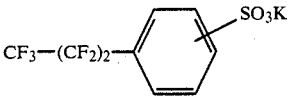

$$CF_3-(CF_2)_7-SO_3K \quad (5)$$

$$CF_3-(CF_2)_{11}-CH_2-OSO_3Na \quad (6)$$

$$H(CF_2)_6-CH_2O(CH_2)_3-SO_3Na \quad (7)$$

$$\begin{array}{l} \quad\quad\quad CH_2-CO_2CH_2-(CF_2)_6H \\ NaO_3S-\underset{\underset{}{|}}{CH}-CO_2CH_2-(CF_2)_6H \end{array} \quad (8)$$

$$\begin{array}{l} CH-CO(OC_2H_4)_4-O-\underset{\underset{}{|}}{CH}-CO_2CH_2CF_2CF_2H \\ \underset{\underset{}{|}}{CH}-CO_2K \quad\quad\quad\quad\quad\quad CH_2-CO_2CH_2CF_2CF_2H \end{array} \quad (9)$$

$$H-(CF_2)_{10}-CO_2Na \quad (10)$$

$$Cl(CF_2-\underset{\underset{Cl}{|}}{CF})_5CF_2-CO_2K \quad (11)$$

$$CF_3-(CF_2)_6-CH=CH-(CH_2)_3-CO_2Na \quad (12)$$

$$CF_3-(CF_2)_3-\underset{\underset{CF_3}{|}}{CF}-(CH_2)_{10}-CO_2Na \quad (13)$$

(14)

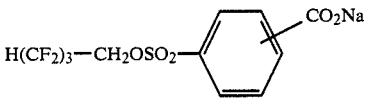

$$CF_3-(CF_2)_7-\underset{\underset{CH_3}{|}}{CON}-(CH_2)_2-CO_2Na \quad (15)$$

$$Cl(CF_2)_6-CO_2Na \quad (16)$$

$$CF_3-(CF_2)_3-CH_2CH_2SO_2\underset{\underset{C_2H_5}{|}}{N}-CH_2CO_2Na \quad (17)$$

-continued $$CF_3(CF_2)_7-SO_2\underset{\underset{C_2H_5}{|}}{N}-CH_2CO_2K \quad (18)$$

$$CF_3(CF_2)_7-SO_2\underset{\underset{C_3H_7}{|}}{N}-CH_2CO_2K \quad (19)$$

$$C_{16}H_{33}-\underset{\underset{SO_3Na}{|}}{CH}-CO_2CH_2CF_3 \quad (20)$$

$$C_{16}H_{33}-\underset{\underset{SO_3Na}{|}}{CH}-CONHCH_2-(CF_2)_2H \quad (21)$$

$$CF_3-\underset{\underset{C_2F_5}{|}}{\overset{\overset{C_2F_5}{|}}{C}}-\underset{\underset{CH_2O(CH_2CH_2O)_7H}{|}}{\overset{\overset{CF_3}{|}}{C}}-CHF-CH_3 \quad (22)$$

$$CF_3-\underset{\underset{C_2F_5}{|}}{\overset{\overset{C_2F_5}{|}}{C}}-\underset{\underset{CO_2(CH_2CH_2O)_4H}{|}}{\overset{\overset{CF_3}{|}}{C}}-CHF-CF_3 \quad (23)$$

$$CF_3-\underset{\underset{C_2F_5}{|}}{\overset{\overset{C_2F_5}{|}}{C}}-\overset{\overset{CF_3}{|}}{CH}-\overset{\overset{CF_3}{|}}{CF}-CO_2Na \quad (24)$$

$$CF_3-(CF_2)_7SO_2\underset{\underset{C_2H_5}{|}}{N}-C_2H_4O-(C_2H_4O)_{10}H \quad (25)$$

$$H(CF_2)_{10}-CH_2OH \quad (26)$$

$$CF_3-(CF_2)_6-CO_2(CH_2-\underset{\underset{CH_3}{|}}{CH}-O)_{\overline{4}}-(CH_2CH_2O)_{20}H \quad (27)$$

$$CF_3-(CF_2)_7SO_2\underset{\underset{CH_3}{|}}{N}-CH_2CH_2OSO_3Na \quad (28)$$

(29)

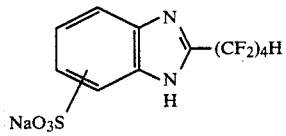

$$C_8F_{17}SO_2\underset{\underset{C_2H_5}{|}}{N}-C_2H_4O-\overset{\overset{O}{||}}{P}(ONa)_2 \quad (30)$$

$$H-(CF_2)_3-O-\overset{\overset{O}{||}}{P}(ONa)_2 \quad (31)$$

$$CF_3-(CF_2)_{12}-CO_2-(C_2H_4O)_{\overline{20}}-H \quad (32)$$

$$CF_3-(CF_2)_6-\underset{\underset{CH_3}{|}}{CON}-C_2H_4O-(C_2H_4O)_{20}H \quad (33)$$

$$F(\underset{\underset{CF_3}{|}}{CF}-CF_2O)_2-\underset{\underset{CF_3}{|}}{CF}-CONH(CH_2)_3CON(CH_3)_2 \quad (34)$$

(35)

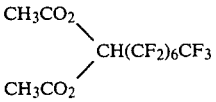

-continued

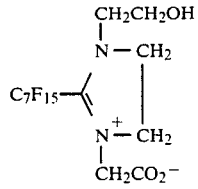

(36)

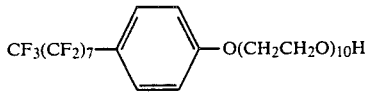

(37)

$H-(CF_2)_6-CH_2O-(CH_2CH_2O)_{10}H$ (38)

$H-(CF_2)_6-CH_2O-(CH_2CH_2O)_{20}H$ (39)

$H-(CF_2)_6-CH_2O-(CH_2CH(OH)-CH_2O)_2-(CH_2CH_2O)_5H$ (40)

The objects of the present invention can be attained by providing, on the separation surface, a layer in a thickness of 0.1 μm or more, preferably 0.5 μm or more, containing the fluorine-containing surfactant.

Further, the fluorine-containing surfactant may be added to other layers provided for other purposes, or may be allowed to be copresent with other binders.

The above-mentioned requirements are not necessarily satisfied by the whole layer containing the fluorine-containing compound, but it suffices that the requirements are satisfied by a portion of the layer of at least 0.1 μm in thickness from the separation surface. Needless to say, the thickness of the portion satisfying the requirements may be thicker than the above-described thickness, or the whole layer may be designed to satisfy the requirements.

The effects of the present invention are particularly remarkable when separation is conducted at elevated temperatures (60° C. or above).

The effects of the present invention may be obtained by incorporating the fluorine-containing surfactant in the uppermost layer of either of the dye-fixing material and the light-sensitive material.

However, in view of production efficiency, image quality, etc., it is pereferable to incorporate the surfactant in the dye-fixing material.

The main reaction mechanisms in the process of the present invention, and other materials to be used when carrying out the process the present invention are described in more detail below.

In the present invention, a mobile dye is produced or released upon the reduction reaction of the light-sensitive silver halide to silver at elevated temperatures as a direct or inverse function of the reaction, meaning that, for example with negative emulsions, exposed silver halide is reduced with a reductive substance, and a mobile dye is imagewise formed as a function of the reaction. The resulting image is negative or positive with respect to the silver image depending upon the type of the reaction. When a positive-working emulsion is used, exact reverse results are obtained as compared to the above-described case. The reaction includes the following types.

European Patent No. 79,056, West German Patent 3,217,853, and European Patent No. 67,455 describe processes for releasing mobile dyes to form an image utilizing a coupling reaction with a reducing agent having been oxidized by oxidation-reduction reaction with silver halide or organic silver salt at elevated temperatures.

In *Research Disclosure,* May, 1978, pp.54–58 (RD-16966) a process is described for introducing a nitrogen-containing heterocyclic group into a dye to form a silver salt thereof, and releasing the dye by heat development.

As to the process of forming positive color image by light-sensitive silver-dye bleach process, useful dyes and bleaching processes are described, for example, in *Research Disclosure,* April, 1976, pp.30–32 (RD-14433); idib., December, 1976, pp.14–15 (RD-15227), U.S. Pat. No. 4,235,957, etc.

Processes for forming color images by utilizing leuco dyes are described, for example, in U.S. Pat. Nos. 3,985,565 and 4,022,617.

Furthermore, various novel materials and processes for forming color images by utilizing heat development have recently been proposed, which are particularly preferably used in the present invention.

Processes of using dye-providing substances which undergo oxidation-reduction reaction with silver halide or organic silver salt at elevated temperature to release mobile dyes are described in European Patent No. 76,492, West German Patent No. 3,215,485, European Patent No. 66,282, Japanese Patent Application Nos. 28928/83 and 26008/83.

Any of the reactions in the above-described processes may be utilized in the present invention, and dye-providing substances used in these processes may be used as the compounds to be used in the present invention which can produce or release mobile dyes.

Dye-providing substances useful in the present invention are represented by the formula $$D-Y \quad (I)$$

wherein D represents a dye moiety or a precursor thereof, and Y represents a substrate which, as a function of oxidation-reduction reaction to be caused in heat development processing, effects a change in the diffusibility of dye-providing substance (I).

The phrase "a change in the diffusibility" as used herein means that (1) an originally non-diffusible compound (I) is rendered diffusible or diffusible dyes are released, or (2) an originally diffusible compound (I) is rendered non-diffusible. This change is caused by oxidation or reduction of Y, depending upon the properties of Y, which may be appropriately selected.

As examples wherein the change in diffusibility is caused by oxidation of Y, there are first illustrated so-called dye-releasing redox substrates such as p-sulfonamidonaphthols (including p-sulfonamidophenols; specific examples being described in Japanese Patent Application (OPI) Nos. 33826/73 and 50736/78, and European Patent No. 76,492), o-sulfonamidophenols (including o-sulfonamidophenols; specific examples being described in Japanese Patent Application (OPI) Nos. 113624/76, 12642/81, 16130/81, 16131/81, 4043/82, 650/82, U.S. Pat. No. 4,053,312, European Patent No. 76,492, etc.), hydroxysulfonamidoheterocyclic compounds (specific examples being described in Japanese Patent Application (OPI) No. 104343/76 and European Patent No. 76,492), 3-sulfonamidoindoles (specific examples being described in Japanese Patent Application (OPI) Nos. 104343/76, 46730/78, 130122/79, 85055/82, and European Patent No. 76,492), etc.

Other examples include those which release dyes by intramolecular nucleophilic attack after oxidation of Y, such as intramolecular assist type substrates described in Japanese Patent Application (OPI) No. 20735/82 and Japanese Patent Application No. 177148/82.

Further examples include substrates which release dyes as a result of an intramolecular cyclization reaction under basic conditions, but, when Y is oxidized, dyes are not substantially released any more (specific examples thereof being described in Japanese Patent Application (OPI) No. 63618/76). As modified examples thereof, those substrates which cause re-cyclization of isoxazolone ring when attacked by a nucleophilic reagent to release dyes (specific examples being described in Japanese Patent Application (OPI) Nos. 111628/74 and 4819/77).

Still further examples include those substrates which release the dye moiety under basic conditions by dissociation of acid proton, but, when Y is oxidized, do not substantially release the dye (specific examples being described in Japanese Patent Application (OPI) Nos. 69033/78 and 130927/79).

On the other hand, examples of those which undergo change in diffusibility upon reduction of Y include nitro compounds described in Japanese Patent Application (OPI) No. 110827/78 and quinone compounds described in Japanese Patent Application (OPI) No. 110827/78, U.S. Pat. Nos. 4,356,249 and 4,358,525. They release a dye by the molecular attack of a nucleophilic group produced by reduction with a reducing agent (called an electron donor) which has not been consumed during thermal development step but remains in the system. As modified examples thereof, quinone type substrates which release a dye moiety by dissociation of acidic proton of the reduction product are also useful. Specific examples are described in Japanese Patent Application (OPI) Nos. 130927/79 and 164342/81. In the case of using the above-described substrates which effect change in diffusibility by reduction reaction, a suitable reducing agent (electron donor) mediating between the silver salt oxidizing agent and the dye-providing substance must be used. Specific examples thereof are described in the above-described known documents. Those substrates which contain an electron donor in substrate Y (referred to as LDA compounds) are also useful.

As still further examples of the image-forming materials, those which are subjected to an oxidation reduction reaction with silver halide or an organic silver salt at elevated temperatures and, as a result, effect change in mobility of the compound having dye moiety are described in Japanese Patent Application No. 39400/83.

Materials which release a mobile dye by the reaction with silver ion in a light-sensitive material are described in Japanese Patent Application No. 55692/83.

Many of the above-described materials are those which form an imagewise distribution of mobile dye in a light-sensitive material as a function of exposure by heat development.

Techniques for transferring (so-called diffusion transfer) the image-forming dyes to a dye-fixing material to visualize the image are described in the above-cited patents or Japanese Patent Application Nos. 42092/83 and 55172/83, etc.

Particularly preferable compounds represented by the formula (I) are described in European Patent No. 76492 and are represented by the following formula (II):

$$R—SO_2—D \qquad (II)$$

wherein R represents a reductive substrate which splits as a direct or inverse function of light-sensitive silver halide having imagewise latent image to release a dye, and which produces difference in mobility between the thus released dye and the dye-providing substance; and D represents an image-forming dye (including a precursor thereof) moiety which becomes mobile when released, with D optionally containing a linking group between the dye moiety and the $SO_2$ group.

The reductive substrate (R) in the dye-providing substrate, $R—SO_2—D$, preferably has an oxidation-reduction potential of 1.2 V or less with respect to a saturated calomel electrode in the measurement of the polarographic half wave potential using acetonitrile as solvent and sodium perchlorate as supporting electrolyte.

General formulae and specific examples of the reductive substrate represented by R are described in European Patent No. 76,492, pp.7–24.

The dye moieties represented by D are those whicch are derived from azo dyes, azomethine dyes, anthraquinone dyes, naphthoquinone dyes, styryl dyes, nitro dyes, quinoline dyes, carbonyl dyes, phthalocyanine dyes, etc., which may temporarily be shifted to the shorter wave-length side. General formulae and specific examples of the dye moiety are described in European Patent No. 76,492, pp.24–42.

Preferable specific examples of the compounds represented by $R—SO_2—D$ are illustrated below.

Yellow dyes:

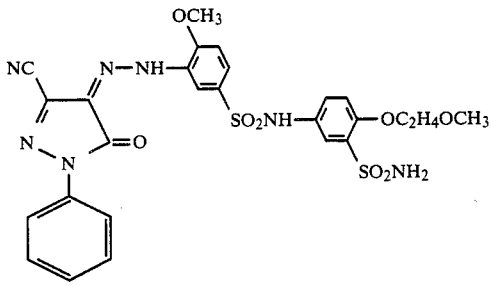

(D-1)

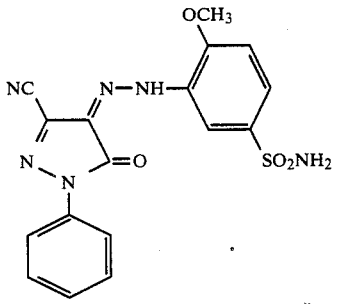

(D-2)

-continued (D-3)

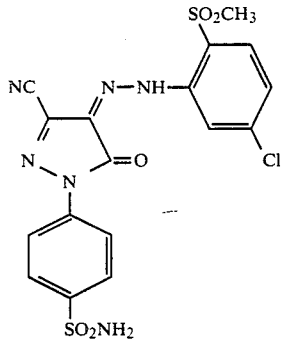

(D-4)

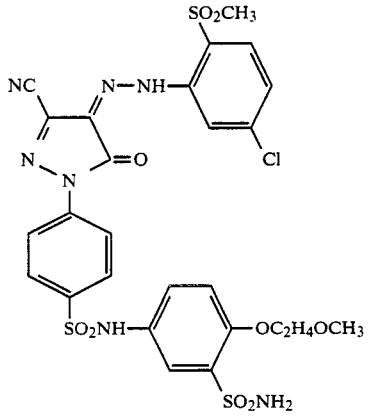

Magenta dye:

(D-5)

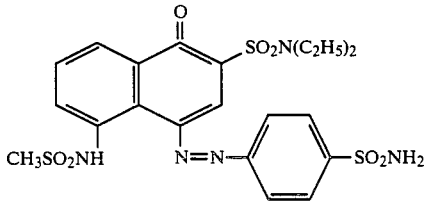

(D-6)

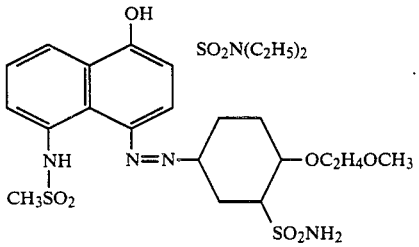

(D-7)

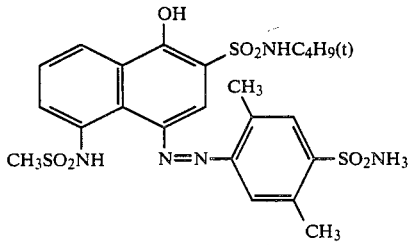

Cyan dyes:

-continued (D-8)

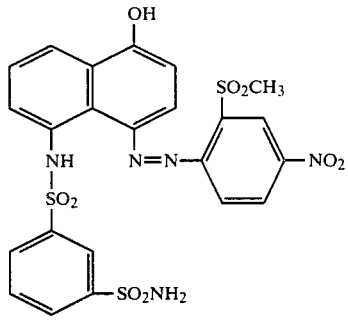

(D-9)

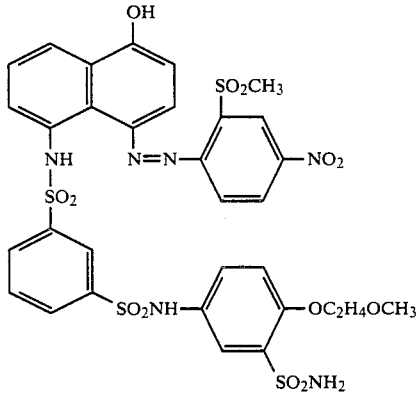

(D-10)

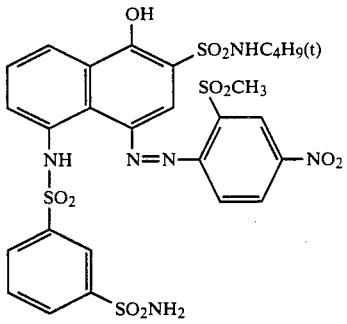

Specific examples of the dye-providing substances that can be used in the present invention include the compounds described in European Patent No. 76,492, pp.43–70, with compounds (1) to (3), (10) to (13), (16) to (19), (28) to (30), (33), (35), (38) to (40), and (42) to (64) described in the European patent being particularly preferable. Furthermore, cyan or yellow dye-providing substances as shown below are also useful.

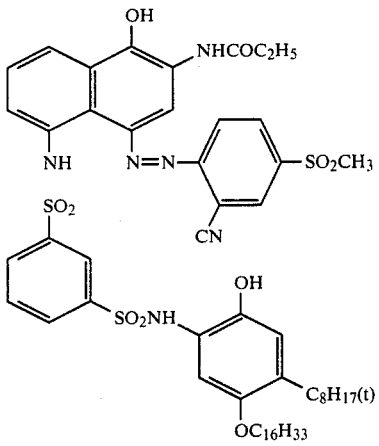

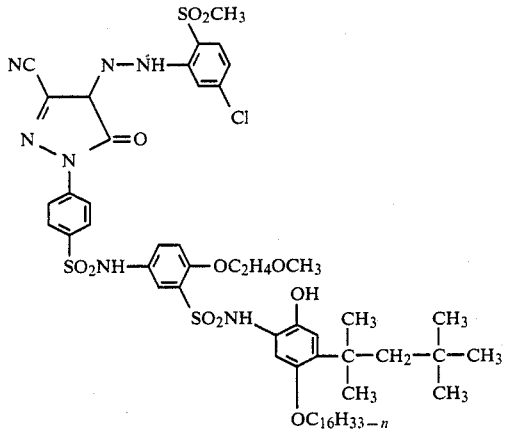

In general, the dye-providing substance is usefully used in an amount of from about 0.01 mol to about 4 mols per mol of silver halide, with an amount of from about 0.03 mol to about 1 mol per mol of silver halide being particularly useful in the present invention.

The dye-providing substances used in accordance with the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye-providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye-providing substance is dispersed in a hydrophilic colloid. For this purpose, the surface active agents illustrated in other part of the specification can be used.

In the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol), N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5; pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The light-sensitive material (photosensitive material) of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)-disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

In the present invention, it is particularly preferred to use various bases or base precursors as dye releasing assistants.

The bases or precursors thereof can be used in a light-sensitive material and/or a dye-fixing material. In the case of incorporating them in a light-sensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or organic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

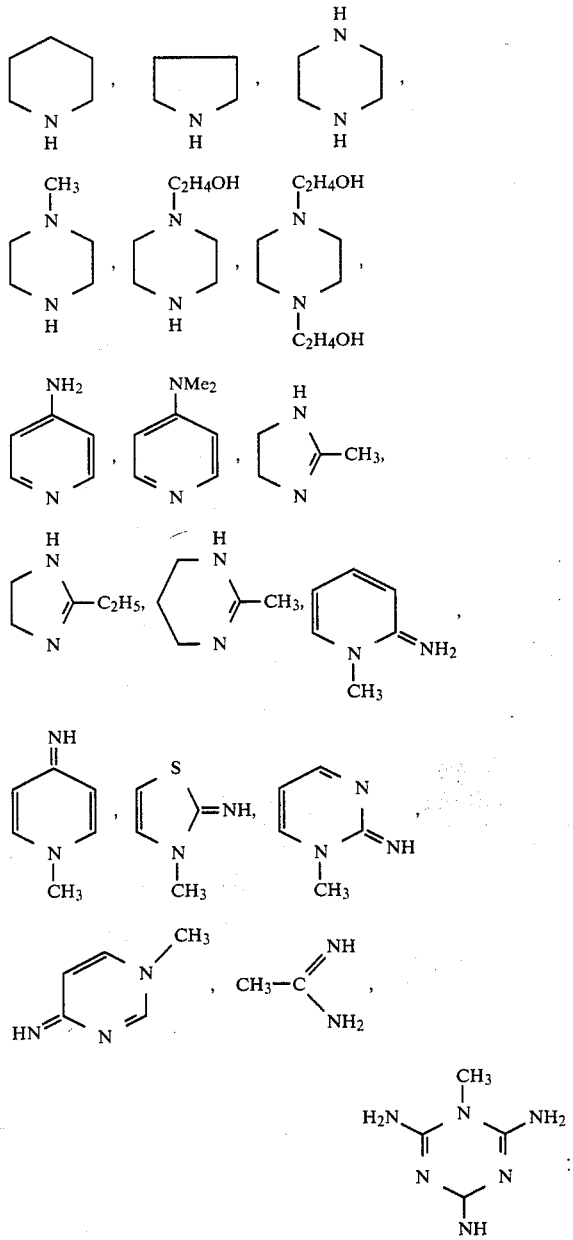

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc., are effective.

Further, amineimides as described in *Research Disclosure,* No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the light-sensitive material, and, preferably a range of from 0.01% by weight to 40% by weight.

The above-described bases or base precursors can be used not only for the acceleration of dye release but also for other purposes such as the control of a pH value.

The above-described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by image-wise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,735,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye-fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye-fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc. which are used individually or as a combination thereof.

In the process of the present invention, the hydrophilic thermal solvent defined hereinabove is present in the light-sensitive element. The hydrophilic thermal solvent is incorporated either into any of the light-sensitive material and the dye-fixing material or into both of them. Although the hydrophilic thermal solvent can be incorporated into any of the emulsion layer, the intermediate layer; the protective layer and the dye-fixing layer, it is preferred to incorporate it into the dye-fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the light-sensitive element of the present invention, for example, sulfamide derivatives, cationic compounds containing a pyridinium group, surface active agents having polyethylene oxide chains, sensitizing dye, antihalation and antiirradiation dyes, hardeners, mordants and so on, are those described in U.S. Pat. Nos. 4,500,626, 4,478,927, 4,463,079, U.S. patent application Ser. No. 582,655 filed Feb. 23, 1984 and U.S. Pat. No. 4,503,137, disclosures of which are incorporated therein by reference. Methods for the exposure and so on cited in the described patents can be employed in the present invention also.

As described above, the present invention is based on the finding that the use of hydrophilic thermal solvents providing excellent effects in dye transfer is necessarily accompanied by other serious problems including adhesion between the light-sensitive material and the dye-fixing material. These problems are much more serious particularly in such a type that the light-sensitive layer and the dye-fixing layer are formed on the same support and have never been noted in the prior art. By incorporating the fluorine-containing surfactant into the light-sensitive element and/or into the dye-fixing material, the adhesion problem has been solved and a high maximum density can be obtained unexpectedly.

The heat developable diffusion transfer color photographic element of the type in which the light-sensitive layer and the dye-fixing material are on the same support has the following basic structure:

A support having provided thereon, in sequence, the dye-fixing layer having incorporated therein a thermal solvent and at least one light-sensitive layer comprising a light-sensitive silver halide and a dye-providing substance, with a fluorine-containing surfactant being incorporated in at least one of the uppermost layers on the contacting sides of the light-sensitive material and of the dye-fixing material.

In the light-sensitive element of this type, the fluorine-containing surfactant is preferably incorporated into a separate layer located between the light-sensitive layer and the dye-fixing layer.

The present invention is now illustrated in greater detail by reference to the following examples which, however, are not to be construed as limiting the present invention in any way.

EXAMPLE 1

A silver bromiodide emulsion was prepared as follows.

40 g of gelatin and 26 g of potassium bromide were dissolved in 3,000 ml of water. This solution was kept at 50° C. and stirred. Then, a solution of 34 g of silver nitrate in 200 ml of wate was added to the above-described solution in ten minutes.

Subsequently, a solution of 3.3 g of potassium iodide in 100 ml of water was added thereto in 2 minutes.

The excess salts in the thus prepared silver bromoiodide emulsion were removed. Then, the pH of the system was adjusted to 6.0 to obtain 400 g of a silver bromoiodide emulsion.

A benzotriazole silver salt emulsion was prepared as follows.

28 g of gelatin and 13.2 g of benzotriazole were dissolved in 3,000 ml of water. This solution was kept at 40° C. and stirred. A solution of 17 g of silver nitrate in 100 ml of water was added thereto in 2 minutes.

The excess salts in the resulting benzotriazole silver salt emulsion were removed. Then, the pH was adjusted to 6.0 to obtain 400 g of a benzotriazole silver salt emulsion.

A gelatin dispersion of dye-providing substance is described below.

5 g of the following magenta dye-providing substance (a), 0.5 g of a surfactant, sodium 2-ethylhexyl sulfosuccinate, and 5 g of tri-cresyl phosphate (TCP) were added to 20 ml of ethyl acetate, and the resulting solution was heated to about 60° C. to prepare a uniform solution. This solution was stirred and mixed with 100 g of a 10% solution of lime-processed gelatin, then the resulting mixture was subjected to dispersion in a homogenizer for 10 minutes at 10,000 RPM. This dispersion was referred to as a dispersion of the magenta dye-providing substance.

Dye-providing substance (a):

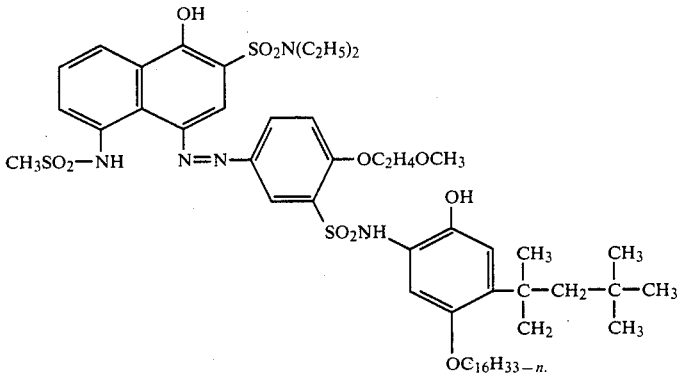

A light-sensitive coating solution was prepared containing the following components.

| | | |
|---|---|---|
| (a) | Silver bromoiodide emulsion | 20 g |
| (b) | Benzotriazole silver salt emulsion | 10 g |
| (c) | Gelatin dispersion of dye-providing substance (a) | 33 g |
| (d) | 5% Aqueous solution of the compound of the following structure: | 5 ml |

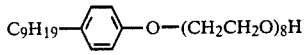

| | | |
|---|---|---|
| (e) | 10% Ethanol solution of guanidine-trichloroacetate | 12.5 ml |
| (f) | 10% Aqueous solution of dimethylsulfamide | 4 ml |
| (g) | Water | 7.5 ml |

The above-described components (a) to (g) were mixed, heated to prepare a solution, then coated on a 180-μm thick polyethylene terephthalate film in a wet thickness of 30 μm.

On the thus formed coating was applied the following composition to form a protective layer.

| | | |
|---|---|---|
| (a) | 10% Gelatin aqueous solution | 35 g |
| (b) | 10% Ethanol solution of guanidine-trichloroacetate | 6 ml |
| (c) | 1% Aqueous solution of sodium 2-ethylhexyl sulfosuccinate | 4 ml |
| (d) | Water | 55 ml |

A solution prepared by mixing the above-described (a) to (d) was coated in a wet thickness of 25 μm, followed by drying to prepare light-sensitive material E-1.

Dye-fixing material R-1 was prepared as follows.

10 g of poly(methyl acrylate-co-N,N,N-trimethyl-N-vinylbenzylammonium chloride) (weight ratio of methyl acrylate to vinylbenzylammonium chloride being 1/1) was dissolved in 200 ml of water, then the solution was uniformly mixed with 100 g of 10 wt% lime-processed gelatin. This mixture solution was uniformly coated on a polyethylene terephthalate film in a wet thickness of 20 μm.

On the thus formed coating was applied a solution prepared by mixing and dissolving the following (a) to (e) in a wet thickness of 60 μm to form a hydrophilic, heat solvent-containing layer, followed by drying.

| | | |
|---|---|---|
| (a) | Urea (thermal solvent) | 4 g |
| (b) | Water | 8 ml |
| (c) | 10% Aqueous solution of polyvinyl alcohol (polymerization degree: 570; saponification degree: 98.5%) | 12 ml |
| (d) | 5% Aqueous solution of the following compound: 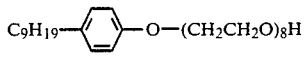 | 2 ml |
| (e) | 5% Aqueous solution of sodium dodecylbenzenesulfonate | 0.5 ml |

Light-sensitive materials E-2 and E-3 were prepared in the same manner as the foresaid light-sensitive material E-1 except for using, in the same amount, fluorine-containing compounds (19) and (25) respectively in place of sodium 2-ethylhexyl sulfosuccinate (c) as a surfactant in the protective layer.

Dye-fixing materials R-2 and R-3 were prepared in the same manner as the aforesaid dye-fixing material R-1 except for using, in the same amount, fluorine-containing compounds (19) and (25) respectively in place of sodium dodecyl benzenesulfonate (e) in the hydrophilic heat solvent-containing layer.

Each of the light-sensitive materials E-1 to E-3 was imagewise exposed for 10 seconds at 2,000 lux using a tungsten lamp, then uniformly heated for 20 seconds on a heat block heated to 140° C.

Then, each of these light-sensitive materials was superposed on each of the dye-fixing materials R-1 to R-3 having been stored for 2 days under a humidity of 20% (25° C.) or less with the coating sides facing to each other, and the assembly was passed between 130° C. heat rollers pressed to each other, immediately followed by heating for 30 seconds at 120° C. on a heat block. After heating, the dye-fixing material was immediately peeled apart from the light-sensitive material. Additional combinations of the light-sensitive materials and the dye-fixing materials tested were as follows.

| Experiment No. | Light-Sensitive Material | Dye-Fixing Material |
|---|---|---|
| 1 | E-1 | R-1 |
| 2 | E-2 | R-2 |
| 3 | E-3 | R-3 |
| 4 | E-1 | R-2 |

-continued

| Experiment No. | Light-Sensitive Material | Dye-Fixing Material |
|---|---|---|
| 5 | E-2 | R-1 |

In every case described above, negative magenta image was formed on the dye-fixing material. However, with comparative experiment No. 1, the coating surface was rough, resulting in poor glossiness. On the other hand, Experiment Nos. 2 to 5 according to the present invention showed extremely good glossiness and extremely good peeling properties.

EXAMPLE 2

The same procedures as described in Example 1 were conducted, except for leaving the assembly of the light-sensitive material and the dye-fixing material (having been heated on the heat block) at a room temperature for ten minutes before peeling the dye-fixing sheet.

In the case of comparative Experiment No. 1, the dye-fixing material was so strongly adhered to the light-sensitive material that it could not be peeled, and, when forcibly peeled, part of the coating of the light-sensitive material was peeled apart from the support. On the other hand, with Experiment Nos. 2 to 5 of the present invention, peeling was easily conducted, resulting in good glossiness of the coating surface.

According to the present invention, the dye-fixing layer to which a dye image has migrated and been fixed can be easily peeled apart from the light-sensitive material after heat development, thus color image with a good glossiness being obtained.

EXAMPLE 3

In order to demonostrate adhesion problem caused by the use of the thermal solvent and demonstrate the effect of the fluorine-containing surfactant for overcoming the adhesion problem, the same procedures as described in Example 1 were conducted except that the dye-fixing material and the light-sensitive material were superposed on the same support in this order and, the light-sensitive materials and the dye-fixing materials given in Table 1 below were used in the presence or absence of urea as the thermal solvent.

After heating for 30 seconds at 120° C., the dye-fixing material was immediately peeled apart from the light-sensitive material. The maximum density (Dmax) of the dye on the thus peeled dye-fixing material was measured with a reflection Macbeth densitometer. The results are also shown in Table 1 below.

TABLE 1

| Exp. No. | Light-Sensitive Material | Dye-Fixing Material | Thermal Solvent | F-Containing Surfactant | Maximum Density (D max) | Surface Glossiness & Other Properties |
|---|---|---|---|---|---|---|
| 6 (comparison) | E-1 | R-10 | — | — | 0.16 | easily peeled apart, glossy |
| 7 (comparison) | E-1 | R-11 | o (DF) | — | 0.98 | Emulsion layer adhered to ca. 60% of the dye-fixing layer, poor glossiness |
| 8 (invention) | E-1 | R-12 | o (DF) | o (DF) | 1.37 | No adhesion, good glossiness |
| 9 (invention) | E-3 | R-11 | o (DF) | o (LS) | 1.29 | same as above |
| 10 (invention) | E-3 | R-12 | o (DF) | o (DF + LS) | 1.35 | same as above |
| 11 | E-1 | R-13 | — | o | 0.19 | easily peeled apart |

TABLE 1-continued

| Exp. No. | Light-Sensitive Material | Dye-Fixing Material | Thermal Solvent | F-Containing Surfactant | Maximum Density (D max) | Surface Glossiness & Other Properties |
|---|---|---|---|---|---|---|
| (comparison) | | | | (DF) | | glossy |

o: incorporated
—: absent
DF: incorporated in the dye-fixing material
LS: incorporated in the light-sensitive material As is evident from the results above, with Experiment No. 6, peeling and glossiness were both good but transfer of the dye occurred only with extreme difficulty. On the other hand, with Experiment No. 7, the dye was considerably transferred but the emulsion layer of the light-sensitive material adhered to about 60% of the surface of the dye-fixing material, resulting in poor glossiness; as a matter of course, Dmax was low due to poor glossiness. To the contrary, in Experiment Nos. 8 through 10 of the present invention, the emulsion layer was not adhered to the dye-fixing material, resulting in good glossiness of the coating surface. From the results, it is understood that due to the incorporation of the hydrophilic thermal solvent such as urea, required for improving transferability of the dye, peeling property is worsened (this tendency is more serious under low humidity conditions) but peeling property can be greatly improved by incorporating the fluorine-containing compound into the light-sensitive material or into the dye-fixing material and further glossiness is improved accompanied by improved peeling property, resulting in increased reflection density.

While the present invention has been described in detail and with respect to specific embodiments thereof, it will be apparent to one skilled in the art that various changes and modifications can be made therein without departing from the spirit and the scope thereof.

What is claimed is:

1. A process for forming a color image which comprises imagewise exposing and then heating a light-sensitive material comprising a support having provided thereon a light-sensitive layer containing silver halide, a binder, and a compound capable of producing or releasing, upon reduction of light-sensitive silver halide to silver at elevated temperatures, a mobile dye, as a direct or inverse function of the reduction reaction, allowing the produced or released mobile dye to migrate into a dye-fixing material having incorporated therein a hydrophilic thermal solvent and fixing the dye thereto, then separating the light-sensitive material from the dye-fixing material, with a fluorine-containing surfactant being incorporated in at least one of the uppermost layers on the contacting sides of the light-sensitive material and of the dye-fixing material at the interface between the light-sensitive material and the dye-fixing material, the light-sensitive material and the dye-fixing material being in contact with each other.

2. A process for forming a color image as in claim 1, wherein the fluorine-containing surfactant is incorporated in an amount of from 0.01 to 3 $g/m^2$.

3. A process for forming a color image as in claim 2, wherein the fluorine-containing surfactant is incorporated in an amount of from 0.05 to 1 $g/m^2$.

4. A process for forming a color image as in claim 1, wherein the fluorine-containing surfactant is incorporated in the uppermost layer of the contacting side of the light-sensitive material.

5. A process for forming a color image as in claim 1, wherein the fluorine-containing surfactant is incorporated in the uppermost layer of the contacting side of the dye-fixing material.

6. A process for forming a color image as in claim 1, wherein the hydrophilic thermal solvent is urea.

7. A process for forming a color image which comprises image-wise exposing and developing a diffusion transfer color light-sensitive element comprising a support having provided thereon, in succession, a dye-fixing material having a dye-fixing layer having incorporated therein a hydrophilic thermal solvent and a light-sensitive layer containing silver halide, a binder, and a compound capable of producing or releasing, upon reduction of light-sensitive silver halide to silver at elevated temperatures, a mobile dye, as a direct or inverse function of the reduction reaction, allowing the produced or released mobile dye to migrate into the dye-fixing material and fixing the dye thereto, then separating the light-sensitive material from the dye-fixing material, with a fluorine-containing surfactant being incorporated in at least one of the uppermost layers on the contacting sides of the light-sensitive material and of the dye-fixing material at the interface between the light-sensitive material and the dye-fixing material, the light-sensitive material and the dye-fixing material being in contact with each other.

8. A process for forming a color image as in claim 7, wherein the fluorine-containing surfactant is incorporated in an amount of from 0.01 to 3 $g/m^2$.

9. A process for forming a color image as in claim 8, wherein the fluorine-containing surfactant is incorporated in an amount of from 0.05 to 1 $g/m^2$.

10. A process for forming a color image as in claim 7, wherein the fluorine-containing surfactant is incorporated in the uppermost layer of the contacting side of the light-sensitive material.

11. A process for forming a color image as in claim 7, wherein the fluorine-containing surfactant is incorporated in the uppermost layer of the contacting side of the dye-fixing material.

12. A process for forming a color image as in claim 7, wherein the hydrophilic thermal solvent is urea.

13. A diffusion transfer color light-sensitive element comprising a support having provided thereon, in succession, a dye-fixing layer having incorporated therein a hydrophilic thermal solvent and a light-sensitive layer containing silver halide, a binder, and a compound capable of producing or releasing, upon reduction of light-sensitive silver halide to silver at elevated temperatures, a mobile dye, as a direct or inverse function of the reduction reaction, with a fluorine-containing surfactant being incorporated in at least one of the uppermost layers on the contacting sides of the light-sensitive material and of the dye-fixing material.

14. A process for forming a color image which comprises imagewise exposing and then heating a light-sensitive material comprising a support having provided thereon a light-sensitive layer containing silver halide, a binder, and a compound capable of producing or releasing, upon reduction of light-sensitive silver halide to silver at elevated temperatures, a mobile dye, as a direct or inverse function of the reduction reaction, allowing the produced or released mobile dye to migrate into a dye-fixing material having incorporated therein a hydrophilic thermal solvent and being in contact with said slight-sensitive material, and fixing the dye thereto, then separating the light-sensitive material from the dye-fixing material, with a fluorine-containing surfactant being incorporated in at least one of the uppermost layers on the contacting sides of the light-sensitive material and of the dye-fixing material.

15. A process for forming a color image as in claim 14, wherein the contacting portions between the image-wise exposed light-sensitive material and the dye-fixing material is in a state being or having been heated at elevated temperature.

16. A process for forming a color image as in claim 15, wherein the elevated temperature is 60° C. or more.

* * * * *